US011465879B2

(12) United States Patent
Kato et al.

(10) Patent No.: US 11,465,879 B2
(45) Date of Patent: Oct. 11, 2022

(54) ELEVATOR ROPE MAINTENANCE METHOD

(71) Applicants: Nippon Otis Elevator Company, Tokyo (JP); Meidensha Corporation, Tokyo (JP)

(72) Inventors: Mitsuru Kato, Inzai (JP); Hirotomo Tanaka, Chiba (JP); Takashi Takeuchi, Tokyo (JP); Ryuji Onoda, Chiba (JP); Yusuke Watabe, Tokyo (JP); Yoshiki Nota, Tokyo (JP); Kazuaki Chida, Tokyo (JP)

(73) Assignees: NIPPON OTIS ELEVATOR COMPANY, Tokyo (JP); MEIDENSHA CORPORATION, Tokyo (JP)

( * ) Notice: Subject to any disclaimer, the term of this patent is extended or adjusted under 35 U.S.C. 154(b) by 590 days.

(21) Appl. No.: 16/477,734

(22) PCT Filed: Jan. 23, 2018

(86) PCT No.: PCT/JP2018/001912

§ 371 (c)(1),
(2) Date: Jul. 12, 2019

(87) PCT Pub. No.: WO2018/139434

PCT Pub. Date: Aug. 2, 2018

(65) Prior Publication Data

US 2019/0359450 A1 Nov. 28, 2019

(30) Foreign Application Priority Data

Jan. 24, 2017 (JP) ..... JP2017-009882

(51) Int. Cl.
*B66B 5/00* (2006.01)
*B66B 7/12* (2006.01)

(52) U.S. Cl.
CPC ..... *B66B 5/0037* (2013.01); *B66B 7/1238* (2013.01)

(58) Field of Classification Search
CPC ..... B66B 5/0037; B66B 7/1238
See application file for complete search history.

(56) References Cited

U.S. PATENT DOCUMENTS

2003/0011483 A1* 1/2003 Lamb ..... B66B 7/1223 187/390
2013/0119256 A1* 5/2013 Husmann ..... D07B 1/145 250/341.1
2013/0126737 A1* 5/2013 Husmann ..... B66B 7/1238 250/341.1

FOREIGN PATENT DOCUMENTS

CN 101259931 A 9/2008
CN 2009191342 A 8/2009
(Continued)

OTHER PUBLICATIONS

International Search Report and Written Opinion for application PCT/JP2018/001912, 11 pages.
(Continued)

*Primary Examiner* — Jeffrey Donels
(74) *Attorney, Agent, or Firm* — Cantor Colburn LLP

(57) ABSTRACT

During a maintenance inspection, an optical rope diameter measuring device is provided at a predetermined position along a path of a wire rope, rope diameter is measured at multiple measuring points while the elevator is driven in test mode, and diameter reduction at each measuring point is determined and stored as a first diameter reduction (S2_S6). During a subsequent maintenance inspection, rope diameter is similarly measured at each measuring point to determine diameter reduction constituting a second diameter reduction (S7_S11). Based on these two diameter reductions, the time at which diameter reduction will reach a predetermined
(Continued)

threshold value is predicted for each measuring point, and the earliest time is displayed as a rope replacement time (S12_S14).

3 Claims, 3 Drawing Sheets

(56) References Cited

FOREIGN PATENT DOCUMENTS

| | | | |
|---|---|---|---|
| CN | 2009249117 | A | 10/2009 |
| CN | 105492363 | A | 4/2016 |
| JP | 2001302135 | A | 10/2001 |
| JP | 2006027888 | A | 2/2006 |
| JP | 2008214037 | A | 9/2008 |
| JP | 2011132010 | A | 7/2011 |
| JP | 2014101197 | A | 6/2014 |

OTHER PUBLICATIONS

Chinese Office Action for Application No. 201880008287.9; dated Jul. 10, 2020; 7 Pages.

* cited by examiner

[Fig. 1]
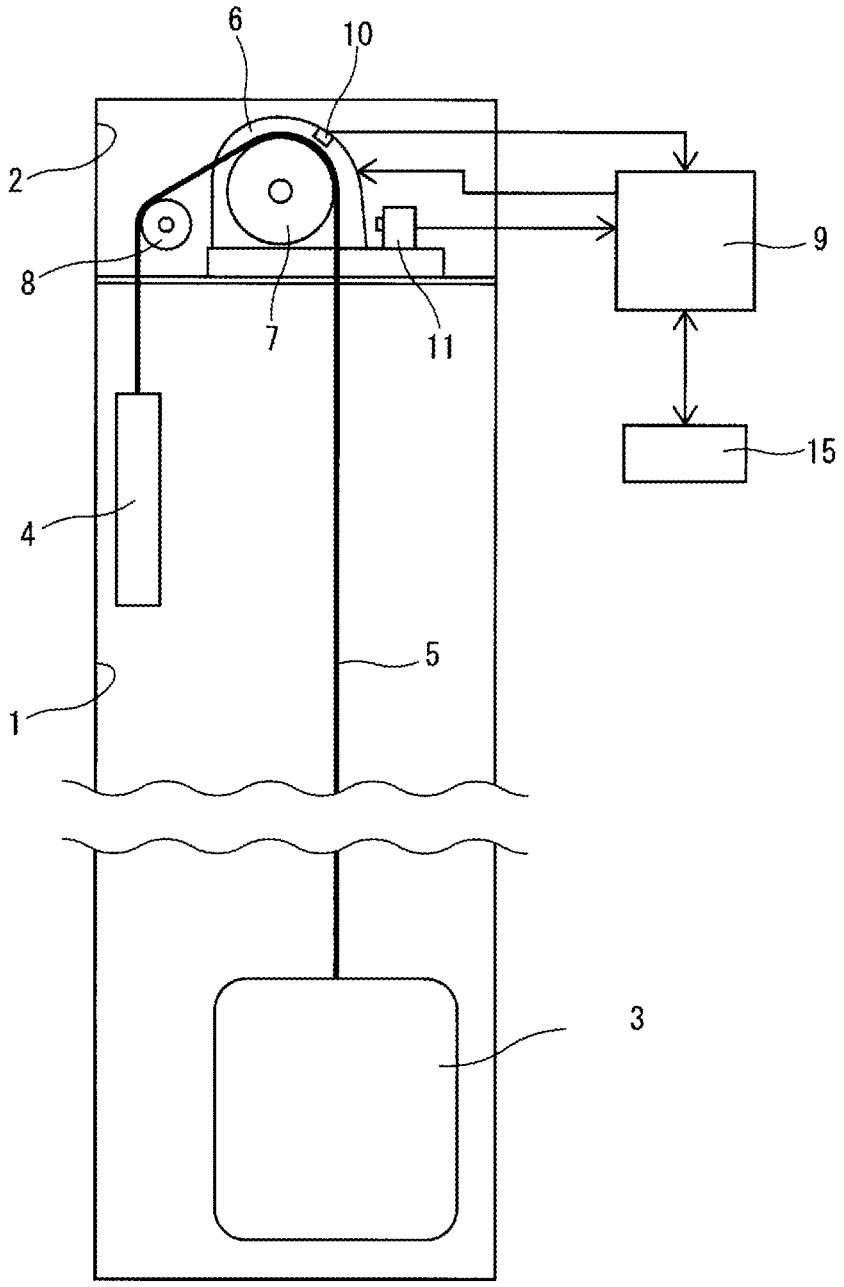

[Fig. 2]
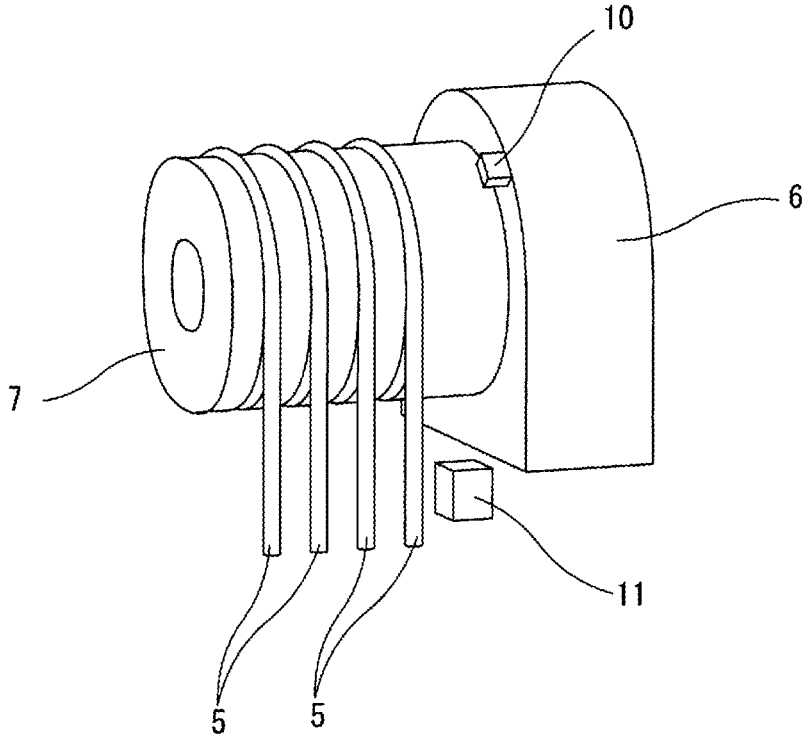
[Fig. 3]
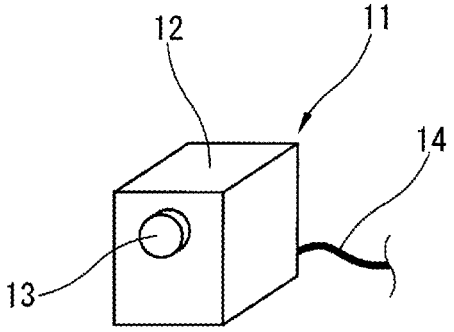

[Fig. 4]
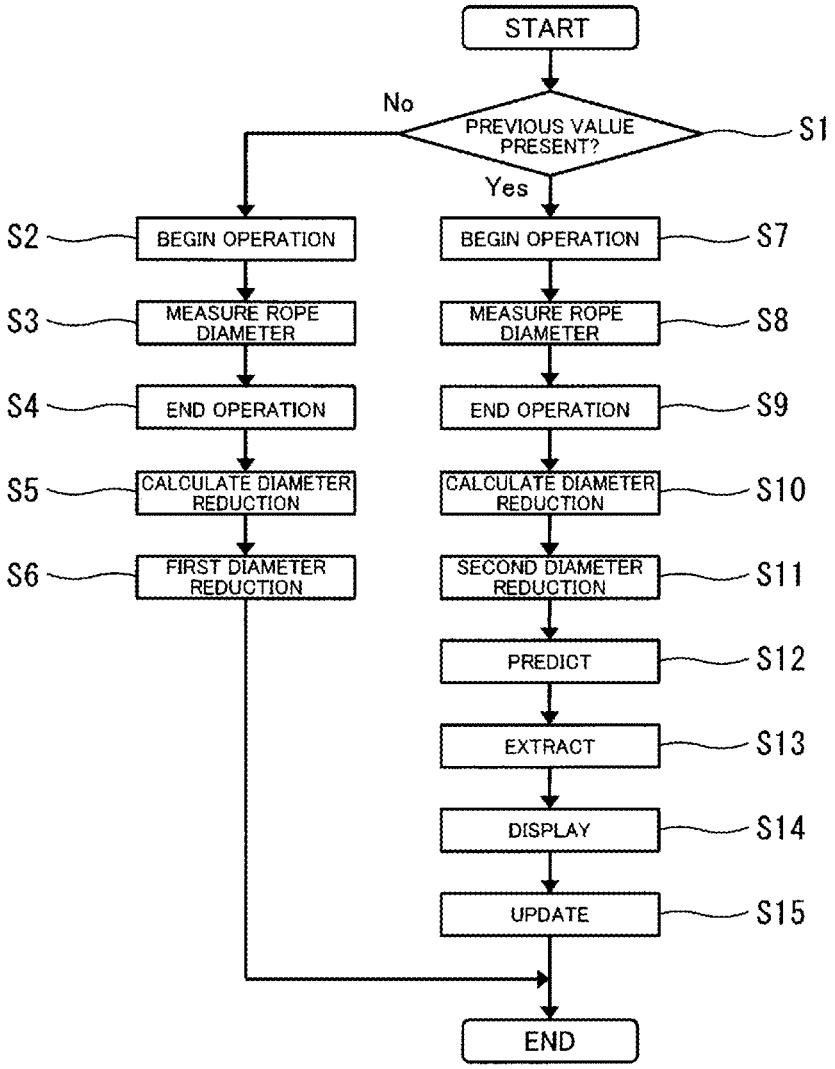
[Fig. 5]
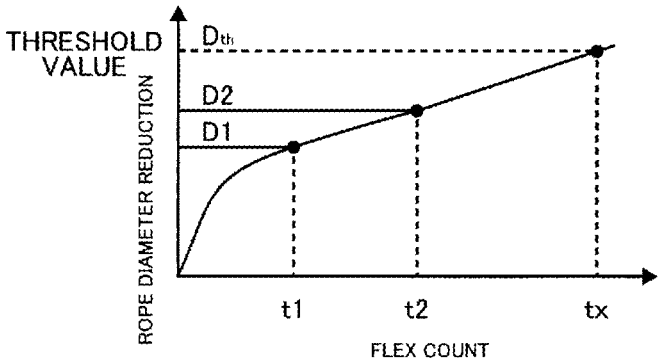

ELEVATOR ROPE MAINTENANCE METHOD

TECHNICAL FIELD

The present invention relates to a rope maintenance method for predicting a rope replacement time constituted by the time when an elevator rope is expected to reach a predetermined diameter reduction.

BACKGROUND ART

Generally, an elevator comprises a car and a counterweight connected by multiple wire ropes, with the car being driven to ascend and descend by the rotation of a drive sheave around which the wire ropes are looped.

The diameters of the wire ropes gradually decreases over time as the ropes extend slightly when placed under tension, and are subjected to wear through contact with the drive sheave and repeated flexural deformation according to the radius of the drive sheave. The proportion of the current diameter of a wire rope to a reference diameter constituted by the diameter of the wire rope at a location that does not contact the drive sheave or the nominal diameter of the wire rope is called the "diameter reduction" of the wire rope; generally, local elevator codes mandate period inspection of rope diameter and the replacement of wire ropes when diameter reduction reaches a predetermined value.

Rope diameter is generally manually measured by a maintenance worker using a measuring instrument such as a vernier caliper, but numerous optical and other non-contact rope diameter measuring devices have also been proposed, as disclosed in Patent Literature 1. In Patent Literature 1, a light-projecting unit and a light-receiving unit are disposed facing each other over a plurality of wire ropes in an elevator machine room, and an output signal of the light-receiving unit is computationally processed to measure the outer diameter of each of the wire ropes.

CITATION LIST

Patent Literature

[PLT 1] Japanese Patent Application Publication No. 2008-214037

SUMMARY OF INVENTION

Technical Problem

As the replacement of an elevator's wire ropes requires the elevator to be taken out of service for a comparatively lengthy period of time, such replacement must be executed in a planned manner, such as by setting a date and time in advance. In addition, it requires several days to procure replacement wire ropes.

In accordance with the rope diameter measuring device of Patent Literature 1, it is a simple matter to measure rope diameter, but it is not possible to immediately estimate when the wire rope will need to be replaced simply by knowing how many millimeters the actual rope diameter is. This results in problems such as needlessly early replacement of the wire rope, or, conversely, the actual replacement being performed later than the appropriate replacement time.

Solution to Problem

The elevator rope maintenance method according to the present invention is for:

an elevator comprising a plurality of wire ropes looped around a drive sheave; characterized in that:

a non-contact rope diameter measuring device is provided at a predetermined position in an elevator shaft along a path of the wire ropes;

at a first inspection time, each rope diameter is measured at multiple measuring points set along each wire rope as a car is raised and lowered;

a diameter reduction for rope diameter against a reference diameter constituted by the diameter of the wire rope at a location that does not contact the drive sheave or by the nominal diameter of the wire rope at each measuring point is stored as a first diameter reduction;

at a second inspection time at a certain period after the first inspection time, rope diameter is again measured at each of the measuring points of each of the wire ropes as the car is raised and lowered;

a diameter reduction for rope diameter against a reference diameter constituted by the diameter of the wire rope at a location that does not contact the drive sheave or by the nominal diameter of the wire rope at each measuring point is stored as a second diameter reduction;

the time at which the diameter reduction at each of the measuring points of each of the wire ropes will reach a predetermined threshold value is determined on the basis of the first diameter reduction, the second diameter reduction, and the period; and the earliest time out of the times for each of the measuring points of each of the wire ropes is displayed as rope replacement time.

The wire ropes exhibit a large amount of initial elongation immediately after a new wire rope starts to be used, but, once this initial elongation has stabilized, the reduction in the diameters of the wire rope is roughly proportional to the number of times the wire ropes are flexed, i.e., the number of days the elevator is in operation. Consequently, it is possible to predict the time at which the diameter reduction at a measuring point is expected to reach the predetermined threshold value from data for two diameter reduction levels measured at a first inspection time and a second inspection time, respectively, after a period of, for example, a few months. The earliest time out of the times measured for the plurality of measuring points for the plurality of wire ropes is the time at which all the plurality of wire ropes is replaced.

In a preferred embodiment of the present invention, a portable non-contact rope diameter measuring device is used as the non-contact rope diameter measuring device, and temporarily mounted at a predetermined position near the drive machine at the inspection times. Using a portable non-contact rope diameter measuring device in this way allows the non-contact rope diameter measuring device to be brought in and diameter reduction to be determined at each measuring point during, for example, period elevator maintenance inspections. Consequently, the present invention can easily be applied to existing elevators.

In another preferred embodiment of the present invention, rope diameter at each measuring point is measured by the non-contact rope diameter measuring device while the elevator is continuously moving, using output from a rotary encoder provided on the drive machine. In other words, by reading the values outputted by the non-contact rope diameter measuring device in sync with the rope positions outputted by the rotary encoder, it is possible to measure rope diameter at each measuring point while the car is continuously moving.

Advantageous Effects of Invention

In accordance with the present invention, it is possible to easily determine the time at which a maintenance worker should replace a rope and carry out rope replacement in a planned manner before the rope diameter is actually reduced below tolerance.

BRIEF DESCRIPTION OF DRAWINGS

FIG. 1 A schematic illustration of an example elevator configuration.

FIG. 2 An illustration of a rope diameter measuring device disposed against a plurality of wire ropes.

FIG. 3 A perspective view of a rope diameter measuring device.

FIG. 4 A flow chart of a process executed by an elevator diagnostic device.

FIG. 5 A graph of predicted diameter reduction at certain measuring points.

DESCRIPTION OF EMBODIMENTS

An example of the present invention will now be described in detail with reference to the drawings.

FIG. 1 shows an example of an elevator configuration to which the rope maintenance method of the present invention is applied. The elevator comprises a car 3 and a counterweight 4 that are ascendingly and descendingly guided along guide rails (not shown) within an elevator shaft 1 above which a machine room 2 is provided. The car 3 and counterweight 4 are connected to each other by multiple (for example, four) wire ropes 5 disposed in parallel, with the middle sections of the wire ropes 5 being looped around a drive sheave 7 and a rotary sheave 8 of a drive machine 6. Consequently, the car 3 is raised and lowered by the driving of the drive machine 6.

The elevator is provided with a control panel 9 for controlling the operation of the drive machine 6, the operation of car doors and landing doors not shown in the drawings, etc. The control panel 9 is disposed in the machine room 2 housing the drive machine 6. The drive machine 6 has, for example, a direct-action configuration in which the drive sheave 7 is mounted on a rotary shaft of a high-torque permanent magnet motor, and is provided with a rotary encoder 10 that detects the amount of rotation of the drive sheave 7, and, by extension, the amount of movement of the wire ropes 5. The control panel 9 precisely controls the position of the car 3 using a signal from the rotary encoder 10.

As part of the rope maintenance apparatus, an optical rope diameter measuring device 11 is disposed in the machine room 2 as a non-contact rope diameter measuring device. The rope diameter measuring device 11 has a configuration analogous to that of a digital camera, and measures the diameters of the wire ropes 5 by photographing the wire ropes 5 and performing image processing upon the acquired image data. The rope diameter measuring device 11 is disposed at a predetermined position along the path of the wire ropes 5 so as to be capable of simultaneously photographing multiple (for example, four) wire ropes 5. Specifically, the device is disposed facing straight portions of the wire ropes 5 extending from the drive sheave 7 toward the car 3, as shown in FIGS. 1 and 2, so as to be capable of measuring rope diameter along substantially the entire lengths of the wire ropes 5, including those parts of the wire ropes 5 that do not contact the drive sheave 7.

FIG. 3 is a schematic illustration of the rope diameter measuring device 11, showing a photography lens 13 within a housing 12. As necessary, a light such as an LED light may be appended to the housing 12. In one example, the rope diameter measuring device 11 is configured as a portal device capable of being brought in by a maintenance worker, and is brought into the machine room 2 during elevator maintenance inspections including inspection of the wire ropes 5. A bracket or the like for anchoring the rope diameter measuring device 11 at the predetermined position is preferably pre-installed in the machine room 2 so that the portal rope diameter measuring device 11 can always be installed at the same position. A cable 14 extending from the housing 12 of the rope diameter measuring device 11 includes an input-output signal line and a power line, and, when installed in the machine room 2, is connected to the control panel 9 by a connector not shown in the drawings.

In the present example, the diameters at locations on the wire ropes 5 that do not contact the drive sheave 7 are used as reference diameters for the wire ropes 5, and diameter reduction is determined via comparison with these reference diameters. Therefore, the rope diameter measuring device 11 does not need to measure the absolute diameters of the wire ropes 5 in terms, for example, of millimeters. In other words, a value such as pixel count can be treated as-is as the diameters of the wire ropes 5.

The rope diameter measuring device 11 may optionally have a transmissive configuration provided with a light-projecting unit and a light-receiving unit disposed facing each other across the wire ropes 5. Additionally, the device may be configured so as to individually photograph each of the plurality of wire ropes 5.

An elevator diagnostic device 15 for performing various types of inspection/diagnosis upon the elevator is used as part of the rope maintenance apparatus. The elevator diagnostic device 15 is constituted by a notebook or laptop computer capable of being carried by a maintenance worker, and is connected to the control panel 9 for use during elevator maintenance inspections. The elevator diagnostic device 15 is provided with a storage medium such as a hard disk, a display device constituted by an LCD or the like, an input device such as a keyboard or a mouse, a communication device for exchanging signals with the control panel 9, and so forth, and software for performing a rope replacement time prediction process is stored in the storage medium.

FIG. 4 is a flow chart of a rope replacement time prediction process performed by the elevator diagnostic device 15. This process is initiated by inputting a specific diagnosis start signal from the elevator diagnostic device 15 after a maintenance worker has installed the rope diameter measuring device 11 at the predetermined during maintenance inspections at predetermined periods (for example, every three months). First, in step 1, it is determined whether there is a previous value constituting a "first diameter reduction", i.e., whether data for a previous value is stored in the storage medium.

In an initial diagnosis, the process proceeds to step 2, and the control panel 9 is used to start the elevator running in test mode. Specifically, the car 3 is raised (or lowered) at low speed by the drive machine 6 from a position at the lowest floor to the highest floor (or, conversely, from the highest floor to the lowest floor). In step 3, rope diameter is measured at each measuring point of the wire ropes 5 by the rope diameter measuring device 11. In one example, substantially the entire length of the wire ropes 5 capable of passing in front of the rope diameter measuring device 11 is divided into 1024 equal sections to set 1024 measuring points, and image data is acquired and subjected to image processing when the measuring points pass in front of the rope diameter measuring device 11 according to the output of the rotary encoder 10, thereby measuring rope diameter at each measuring point. In other words, by reading the values outputted by the non-contact rope diameter measuring device 11 in sync with the rope positions outputted by the rotary encoder 10 while the car 3 is continuously moving, rope diameter is measured at each measuring point while the car 3 is continuously moving. Once measurement at each of the 1024 measuring points is finished, test mode operation of the elevator is ended in step 4.

Next, in step 5, rope diameter reduction at each measuring point is calculated. Specifically, rope diameter at a specific measuring point, out of the 1024 measuring points at which rope diameter was measured in step 4, at a location on the wire ropes 5 that does not contract the drive sheave 7 (in the example shown in FIG. 1, the ends by the car 3) is used as a reference diameter, and the proportion of the rope diameter with respect to the reference diameter, expressed as a percentage, is considered the "diameter reduction" at each measuring point. Therefore, if the measured rope diameter is equal to the reference diameter, the diameter reduction is "100(%)". In this way, diameter reduction at each of the 1024 measuring points is determined. Next, in step 6, the diameter reduction at each of these 1024 measuring points is stored as a "first diameter reduction" for each measuring point in the storage medium of the elevator diagnostic device 15. The measured rope diameter at each measuring point may be stored as well. Specifically, because there are multiple (for example, four) wire ropes 5, as discussed above, 1024 first diameter reductions are determined for each of the wire ropes 5.

This completes the work performed during the initial maintenance inspection. The maintenance worker can remove and leave with the rope diameter measuring device 11 until the next maintenance inspection time.

Next, after a specific period (for example, three months) has passed and maintenance inspection time has arrived, similar work is performed; this time, because previous value data in the form of "first diameter reduction" is present in the storage medium of the elevator diagnostic device 15, the process proceeds from step 1 to step 7 and onward. The process performed in steps 7_10 is similar to the process performed in steps 2_5, with test mode operation being started in step 7, rope diameter being measured at, for example, 1024 set measuring points in step 8, each diameter reduction being determined in step 9, and elevator operation being ended in step 10. The reference diameter used at this time may be a rope diameter newly measured at a location on the wire ropes 5 that does not contact the drive sheave 7, or the initial reference diameter used to calculate first diameter reduction. Next, in step 11, the diameter reduction at each of these 1024 measuring points is stored as a "second diameter reduction" for each measuring point.

Next, in step 12, the first diameter reduction and second diameter reduction at each measuring point are used to determine the time at which diameter reduction at the measuring point in question is expected to reach a predetermined threshold value. The maximum diameter reduction permitted by elevator code, for example, is set as the threshold value. In other words, FIG. 5 shows the relationship between the number of times the rope is flexed (X axis) and diameter reduction (Y axis); as shown in the drawing, the wire ropes 5 exhibit a drastic reduction in diameter, so-called initial elongation, immediately after use of new ropes is begun, but, once this initial elongation has stabilized, the progress of the reduction in the diameters of the wire ropes is roughly proportional to the number of times the wire ropes are flexed. The number of times the wire ropes 5 are flexed is roughly proportional to the number of days the elevator is in operation; thus, the X axis in FIG. 5 can be considered time (for example, months). Accordingly, diameter reduction at one maintenance inspection time t1, i.e., first diameter reduction D1, and diameter reduction at a time t2 after a certain period (for example, three months) has elapsed, i.e., second diameter reduction D2 can be used to predict the flex count required for diameter reduction to reach a specific threshold value Dth, and, by extension, the time tx at which the threshold value Dth will be reached. If, for example, the elevator is out of service for an extended period, the flex count required for diameter reduction to reach the specific threshold value Dth may be calculated, followed by adding a suitable correction corresponding to the flex count to the time tx.

In step 12, time tx is calculated for all 1024 measuring points. More specifically, time tx is determined for the 1024 measuring points on all of the plurality of wire ropes 5. Thus, if, for example, there are four wire ropes 5, a time tx is obtained for 1024×4 locations.

Next, in step 13, the multiple times tx thus determined are compared to extract the earliest time tx. Then, in step 14, the earliest time tx is displayed on the display of the elevator diagnostic device 15 as the wire rope 5 replacement time, and stored in the storage medium. This allows the maintenance worker to determine, easily and in advance, when to replace the wire ropes 5.

In step 15, the current diameter reduction calculated as "second diameter reduction" in steps 10 and 11 is stored as "first diameter reduction" for each measuring point. In other words, the previous value for "first diameter reduction" is updated to the current value for second diameter reduction, and saved as a new "first diameter reduction".

Thus, after a specific period (for example, three months) has elapsed and the next maintenance inspection time is reached, the newly acquired "second diameter reduction" is use to predict the time to replace the wire ropes 5. When replacement time is repeatedly predicted in this way every three months, for example, the predicted replacement time will eventually be relatively soon (for example, sooner than the next scheduled maintenance inspection); thus, the actual wire rope 5 replacement schedule, arrangements for procuring replacement wire ropes 5, etc., can be performed according to this predicted replacement time.

When calculating diameter reduction, the nominal diameter of the wire ropes 5 provided, for example, by the manufacturer of the wire ropes 5 may be used as the "reference diameter" instead of the actual rope diameter at a location on the wire ropes 5 that does not contact the drive sheave 7.

Thus, in accordance with the rope maintenance method according to the present invention, it is possible to predict in advance when the wire ropes 5 should be replaced, and replace the wire ropes 5 at a suitable time, before rope diameter actually decreases below tolerance. In particular, in accordance with the examples described above, a portable rope diameter measuring device 11 is used, and the positions of the measuring points on the wire ropes 5 are identified using the output of a rotary encoder 10 on the drive machine 6, thereby enabling easy application of the rope maintenance method according to the present invention to existing elevators.

Naturally, the rope diameter measuring device 11 may also be permanently disposed at a suitable position along the elevator shaft 1 in the present invention. A rope replacement time prediction function according to the present invention may be incorporated into the control panel 9 as a diagnostic function.

The elevator configuration depicted in FIG. 1 is merely an example; the present invention may also be broadly applied to elevators employing other roping methods, elevators not comprising a machine room 2, and so forth.

REFERENCE SIGNS LIST

1: Elevator shaft
2: Machine room
3: Car
4: Counterweight
5: Wire rope
6: Drive machine
7: Drive sheave
9: Control panel
10: Rotary encoder
11: Rope diameter measuring device
15: Elevator diagnostic device

The invention claimed is:

1. A rope maintenance method for an elevator comprising a plurality of wire ropes looped around a drive sheave; characterized in that:

a non-contact rope diameter measuring device is provided at a predetermined position in an elevator shaft along a path of the wire ropes;

at a first inspection time, each rope diameter is measured at multiple measuring points set along each wire rope as a car is raised and lowered;

a diameter reduction for rope diameter against a reference diameter constituted by the diameter of the wire rope at a location that does not contact the drive sheave or by the nominal diameter of the wire rope at each measuring point is stored as a first diameter reduction;

at a second inspection time at a certain period after the first inspection time, rope diameter is again measured at each of the measuring points of each of the wire ropes as the car is raised and lowered;

a diameter reduction for rope diameter against a reference diameter constituted by the diameter of the wire rope at a location that does not contact the drive sheave or by the nominal diameter of the wire rope at each measuring point is stored as a second diameter reduction;

the time at which the diameter reduction at each of the measuring points of each of the wire ropes will reach a predetermined threshold value is determined on the basis of the first diameter reduction, the second diameter reduction, and the period; and the earliest time out of the times for each of the measuring points of each of the wire ropes is displayed as rope replacement time.

2. The elevator rope maintenance method according to claim 1, wherein a portable non-contact rope diameter measuring device is used as the non-contact rope diameter measuring device, and temporarily mounted at a predetermined position near a drive machine at the inspection times.

3. The elevator rope maintenance method according to claim 1, wherein rope diameter at each measuring point is measured by the non-contact rope diameter measuring device while the elevator is continuously moving, using output from a rotary encoder provided on the drive machine.

* * * * *